US006898957B2

(12) United States Patent
Slack

(10) Patent No.: US 6,898,957 B2
(45) Date of Patent: May 31, 2005

(54) METHOD OF REDUCING SLOT WIDTH IN SLOTTED TUBULAR LINERS

(75) Inventor: Maurice William Slack, Edmonton (CA)

(73) Assignee: Regent Technologies Ltd., Nisku (CA)

( * ) Notice: Subject to any disclaimer, the term of this patent is extended or adjusted under 35 U.S.C. 154(b) by 130 days.

(21) Appl. No.: 10/399,990

(22) PCT Filed: Oct. 23, 2001

(86) PCT No.: PCT/CA01/01489

§ 371 (c)(1),
(2), (4) Date: Apr. 24, 2003

(87) PCT Pub. No.: WO02/34423

PCT Pub. Date: May 2, 2002

(65) Prior Publication Data

US 2004/0035169 A1 Feb. 26, 2004

(30) Foreign Application Priority Data

Oct. 26, 2000 (CA) ..... 2324730

(51) Int. Cl.[7] ..... B21D 3/02

(52) U.S. Cl. ..... 72/122; 72/78; 72/95; 72/121; 72/126

(58) Field of Search ..... 72/77, 78, 84, 72/95, 98, 100, 105, 106, 112, 121, 122, 123, 126; 29/896.6, 896.61, 896.62

(56) References Cited

U.S. PATENT DOCUMENTS

| | | | | | |
|---|---|---|---|---|---|
| 965,855 | A | | 8/1910 | Baur | |
| 1,027,917 | A | | 5/1912 | Smith | |
| 1,028,065 | A | | 5/1912 | Smith | |
| 1,028,066 | A | | 5/1912 | Smith | |
| 1,055,675 | A | | 3/1913 | Smith | |
| 1,207,808 | A | | 12/1916 | Steps | |
| 1,207,809 | A | | 12/1916 | Steps | |
| 1,271,787 | A | | 7/1918 | Smith | |
| 1,566,624 | A | | 12/1925 | Smith | |
| 1,579,846 | A | | 4/1926 | Steps | |
| 1,652,208 | A | | 12/1927 | McEvoy, Jr. | |
| 1,654,160 | A | | 12/1927 | Coberly | |
| 1,654,618 | A | | 1/1928 | Steps | |
| 1,685,287 | A | | 9/1928 | McEvoy, Jr. | |
| 1,782,518 | A | | 11/1930 | Steps | |
| 1,868,900 | A | | 7/1932 | Hayes | |
| 2,111,680 | A | | 3/1938 | Tow | |
| 2,306,945 | A | | 12/1942 | Hebron | |
| 2,358,873 | A | | 9/1944 | Moss | |
| 3,520,418 | A | | 7/1970 | Guinard | |
| 4,004,441 | A | * | 1/1977 | Leszak | 72/75 |
| 4,179,911 | A | | 12/1979 | Saier et al. | |
| 4,313,248 | A | * | 2/1982 | Fujikake | 29/890.051 |
| 4,425,696 | A | * | 1/1984 | Torniainen | 72/96 |
| 4,794,775 | A | * | 1/1989 | Kuwahara et al. | 72/78 |
| 4,932,112 | A | | 6/1990 | Tikkanen | |
| 5,365,763 | A | * | 11/1994 | Cretin et al. | 72/98 |
| 6,112,570 | A | | 9/2000 | Hruschak | |

FOREIGN PATENT DOCUMENTS

| | | |
|---|---|---|
| CA | 2188743 A1 | 12/1996 |
| CA | 2299092 A1 | 5/2000 |

* cited by examiner

*Primary Examiner*—Ed Tolan
(74) *Attorney, Agent, or Firm*—Donald V. Tomkins

(57) ABSTRACT

A method of reducing slot width in slotted tubular liners. A slotted tubular liner (1) is provided having an interior surface (3), an exterior surface (2) and a plurality of slots (4) extending between the interior surface and the exterior surface. One or more contoured rigid forming tools (7) are provided. Pressure is applied to either the interior surface (3) or the exterior surface (2) of the slotted tubular liner (1) with the contoured rigid forming tools (7). The contoured rigid forming tools are then moved in a sweep pattern traversing either the interior surface or the exterior surface of the slotted tubular liner, until plastic deformation narrows the width of the plurality of slots (4) to within desired tolerances. The method does not require the same precise positioning of previously known methods and, as such, provides a combination of increased output and lower cost.

33 Claims, 4 Drawing Sheets

METHOD OF REDUCING SLOT WIDTH IN SLOTTED TUBULAR LINERS

This application is a 35 USC 371 of PCT/CA01/01489 filed Oct. 23, 2001.

FIELD OF THE INVENTION

Metal tubulars having through-wall slots are commonly used to line bore holes in porous earth materials to exclude entry of solid particles while permitting fluid flow through the tubular wall. The present invention provides a method to form the edges of such slots to substantially reduce the slot width and preferentially form the shape of the through-wall flow channel.

BACKGROUND OF THE INVENTION

Technological advances in directional drilling within the oil industry have enabled wells to be completed with long horizontal sections in contact with the reservoir. Such long horizontal well bores, often in excess of 1,000 m, permit fluids to be injected into or produced from a much greater portion of the reservoir, than would be possible from a vertical well, with commensurately greater recovery of petroleum from a single well. The greater petroleum recovery possible from such wells, more than justifies the increased cost of drilling and completing the horizontal well section. Additionally, horizontal wells require fewer wellheads with less surface disturbance to exploit the same reserves, providing a collateral environmental benefit. These reasons are strong motivators to ensure technically and economically viable products are available to complete these wells.

For such reservoirs the horizontal section is often completed with slotted steel tubulars (referred to as slotted liners) to prevent closure of the hole through collapse and to function as a screen or filter permitting flow of injected or produced fluids across the tubular wall while excluding solids. The present invention was conceived as a means to improve both the technical and commercial viability of slotted liners, particularly needed where the reservoir material is comprised of weak fine-grained materials.

To function effectively as a filter and structural support member in fine-grained reservoirs, and to be sufficiently rugged to endure installation handling loads, the slotted liner design is driven by three somewhat competing needs. To ensure adequate solid particle exclusion, the slot width must be on the order of the smaller sand grain size. This is generally true even where fluids are injected, because the effective radial stress in the sand tends to force sand grains into the well bore, even though the fluid flows out. For reservoirs comprised of very fine-grained material, slots less than 0.15 mm may be required. But small slot widths tends to increase flow loss, therefore a greater number of slots are needed per unit of contacted reservoir area to maintain flow capacity, while the greater number of slots must be accommodated without undue loss of structural capacity. The industry also recognises advantages for production applications, if the slot has a 'keystone' shape, i.e., the flow channel through the tubular wall diverges from the external entry to internal exit point. This geometry reduces the tendency for sand grains to lodge or bridge in the slot, causing it to plug and restrict flow.

As pointed out by Hruschak in U.S. Pat. No. 6,112,570, the methods usually used to cut slots through the wall of steel tubulars having a wall thickness great enough to provide adequate structural support in horizontal wells, are not readily applicable for widths less than 0.4 mm. Hruschak then goes on to disclose a method where this limitation is overcome by deforming or forming one or both of the external edges of a longitudinal slot, placed in the wall of a steel tubular, to narrow the slot width along its exterior opening. This method relies on applying pressure along at least one of the longitudinal edges, preferably by means of a roller, where such pressure is sufficient to cause local plastic deformation of the metal, and thus permanently narrow the slot to a desired width. As recognized by Hruschak and others using similar methods, such as Steps in U.S. Pat. No. 1,207,808, this method of forming the exterior longitudinal edges of a slot, has the added advantage of producing a 'keystone' slot shape where the through-wall channel shape diverges from the exterior to interior edges of the slot. Processes employing such methods to narrow the slot width by applying pressure at or along a slot edge to plastically deform it inward are referred to as seaming.

It will be apparent to one skilled in the art that methods of reducing the slot width by the application of pressure along or parallel to the edge of a slot, as described by Steps or Hruschak, will be sensitive to the location where pressure is applied. Specifically, the amount by which the slot width is decreased depends strongly on the distance between two parallel lines, one coinciding with the slot centre and the second with the longitudinal force centre of the pressure applied along the slot length. The alignment tolerance may thus be defined as the allowable range of distance between these two lines to meet the required tolerance in final slot width. The required tolerance in slot width is typically in the order of +/−0.02 mm. With practical seaming tooling, the associated alignment requirements can be in the order of +/−0.1 mm.

Hence such methods require relatively accurate alignment of the load application means, such as a forming roller, with respect to the circumferential position of longitudinal slots. To implement this method in a mechanised process capable of forming a large number of slots on full-length tubulars, therefore requires considerable sophistication to co-ordinate the positioning of tooling required to perform the respective cutting and seaming operations if conducted sequentially in a single machine. Even further sophistication is required if the cutting operation is performed independent of the seaming. The capital cost associated with such machinery make it difficult to obtain economically viable rates of production on full-length tubulars, particularly so if the slotting is conducted independent of the seaming.

However it is particularly attractive to decouple the cutting and seaming operations as this allows seaming to be conducted on tubulars slotted by various independent suppliers, improving the economics of supply. In this case, circumferential positioning of the longitudinal seaming tools must account for a degree of randomness in the circumferential distribution of slots obtained from typical suppliers of slotted liner that significantly exceeds the allowable alignment tolerance.

SUMMARY OF THE INVENTION

What is required then, is a method of narrowing the width between the exterior edges of longitudinal slots placed through the wall of metal tubulars, that readily accommodates variations in longitudinal or circumferential slot placement position and is amenable to implementation in a mechanised process.

To meet these objectives, the method of the present invention provides at least one rigid contoured forming tool with means to apply a largely radial load to force it into contact with the inside or outside cylindrical surface of a slotted metal tubular member, the contacted surface. The radial load thus applied at a location on the contacted surface, creates a localized zone of concentrated stress within the tubular material where it is contacted, which stress is sufficiently great to cause a significant zone of plastic deformation if the contact location is near the edge of a slot. Means are also provided to simultaneously displace said forming tool or tools with respect to the tubular along path lines comprising a sweep pattern on the surface of the tubular. The sweep pattern is arranged so that the extended zone of plastic deformation created as the forming tool passes each point on the path-line covers an area sufficient to intersect the edges of all slots to be formed. The method thus consists of ensuring the paths followed by the displacement of the forming tool or tools while conducting said sweep pattern, traverse the edges of the slots at a sufficient number of locations and a sufficient number of times while maintaining sufficient contact force to plastically form the edges of any slots intersected along their entire length. The plastic deformation or forming thus caused at the edges of the slots tends to narrow the width between opposing slot edges along its opening in the contacted surface of the slotted metal tubular. Otherwise stated, the method requires that the area swept by said extended zone of localized plastic flow, as one or more rigid contoured forming tools are caused to move over the inside or outside surface of the slotted metal tubular member, be sufficient to more than completely cover the edges of all slots to be narrowed by plastic deformation. The swept area need not be continuous over the entire surface of the slotted tubular member but must include the area of influence from path lines occurring at at least two separate locations for each slot narrowed.

The primary purpose of the present invention is to employ this method to form the outer edges of largely longitudinally oriented slots placed in the wall of tubulars suitable for use as liners in wells. The method is comprised of firstly providing such slotted pipe where the slots,

- extend through the tubular wall providing fluid communication when in service,
- have longitudinal peripheral edges,
- are preferably of approximately equal length,
- usually have parallel walls,
- are preferably arranged in rows of circumferentially, approximately evenly-distributed slots, with rows separated by short unslotted intervals or rings, effectively forming a structure where the material between slots act as short beams joining rings formed by the unslotted intervals, and
- groups of one or more rows of slots are referred to as a slotted interval.

Secondly, providing at least one contoured rigid forming tool, preferably in the form of a roller. Thirdly applying pressure to a local area on the exterior surface of the tubular through the rigid contoured forming tool or tools beginning at one end of a slotted interval. Fourthly, execute a sweep pattern by moving the forming tool or tools with respect to the pipe to cause it or them to traverse the surface of the tubular along a largely helical path a sufficient distance to at least cover the slotted interval. The contoured forming tool shape, the radial load by which the forming tool is forced against the tubular surface, the pitch of the helical path and the number of times the operation is repeated are all adjusted to deform the edges of the slots along their length sufficient to continuously narrow each slot to the desired width.

It will be appreciated by one skilled in the art that the helical sweep pattern employed here is readily able to 'find' the edges of all slots and thus cause them to be formed continuously along their length and that such helical patterns are commonly used in straightforward production machining operations such as turning or threading. This embodiment of the method of the present invention is thus simple to mechanise, readily locates the edges of slots to be formed and may be performed at high enough surface speeds to readily meet high production rate requirements. In comparison to the prior art, it therefore enjoys the benefits of simplified mechanization and therefore reduced capital cost and higher production rate and is insensitive to variability in the circumferential position of longitudinal slots.

As recognized by Hruschak, the through-wall channel shape, created by such an exterior forming process, is diverging with respect to fluid flow from the exterior to interior of the tubular. This 'keystone' shape provides the advantage of reduced plugging tendency under inflow or production conditions. However if the liner is used in an injection application, fluid flow is from the interior to exterior and the channel shape becomes converging with respect to the fluid flow direction. Where the injected fluid contains particulate matter introduced from sources such as the feed stock, mill scale and corrosion products from upstream piping, or chemical participates, this converging channel shape thus tends to encourage plugging and therefore becomes a disadvantage for injection applications.

An additional purpose of the present invention is therefore to provide a method to narrow the width of largely longitudinally oriented slots placed in the wall of metal tubulars suitable for use as liners in wells along their interior edges. To meet this purpose the method of the present invention is applied following steps identical to those described for forming the exterior edges of longitudinal slots except the rigid forming tool or tools are configured to apply pressure to the interior surface of the slotted tubular. This causes the slot width to be narrowed along its interior edges creating an inverse keystone flow-channel shape, which shape is desirable for injection applications.

The geometry of the generally keystone channel shape created by forming the edges of slots may be further characterized in terms of the rate at which the slot width increases with depth from the contacted surface edges, i.e., its divergence rate. It will be generally appreciated that slots with a lesser divergence rate can be expected to plug more easily than slots with a greater divergence rate for the same reason that the keystone shape is preferred over parallel wall slots. However if the divergence rate is very great the formed edges must have less material supporting them and are therefore more susceptible to material loss through erosion or corrosion. In applications where this material loss causes a significant increase in width the ability to screen to the desired particle size is compromised.

It is therefore advantageous if the method of forming the slot edges has the ability to, not only narrow the slot width, but to control the rate of divergence to more optimally meet the needs of varying applications. The methods of applying pressure along the edges of a longitudinal slot placed in a tubular work piece to narrow the slot width, as taught by Hruschak, partially enable such control but are subject to significant limitations particularly when mechanized. These limitations may be understood by considering how the transverse shape of the forming tool surface in contact with the tubular, affects the slot divergence rate. This shape may be generally described in terms of its transverse curvature of the forming tool, which may range from convex to concave and is typically provided as a contoured roller. Hruschak, points out various disadvantages of forming the edges of slots with rollers having a convex radius of curvature, much less than the radius of the pipe, and intended to "bridge" the slot in the manner taught by Steps. Therefore the more practical range of roller curvature is from slightly concave, through flat to convex. Within this range, it will be evident that a flat or convex roller shape when aligned with the slot and loaded to cause plastic deformation sufficient to narrow the slot to a desired width will tend to plastically flow material over a greater distance on each side of the slot to a correspondingly greater depth resulting in a lesser divergence rate than would be obtained using a more convex roller. While this relationship is known in the art, it will also be apparent that if highly convex rollers are used, greater alignment precision is required to obtain consistent control of slot width. However as already noted, precise circumferential alignment of the forming rollers with each slot is difficult to achieve in a cost effective mechanized process.

It is therefore an additional purpose of the present invention to provide a method to narrow the width of slots placed in the wall of metal tubulars by forming the slot edges and to additionally control the slot divergence rate or depth to which it is narrowed, thereby retaining several of the advantages enjoyed by forming methods in the prior art relying on application of pressure along the slot edge while overcoming certain shortcomings. This purpose is realized while practising the method of the present invention by manipulating the forming tool shape according to the following understandings. Without limiting finer distinctions in geometry, the forming tool shape, in its region of contact with the work piece, may be generally characterized in terms of its curvature in the longitudinal and transverse directions, which directions are with reference to cylindrical co-ordinates of the tubular work piece. Curvature magnitude is to be understood as the inverse of radius of curvature, and considered positive for convex forming tool shapes, zero for flat or straight shapes and therefore negative for concave shapes. To obtain a greater divergence rate, the forming tool curvature is decreased in one or both of the transverse and longitudinal directions. Conversely to obtain a lessor divergence rate, curvature is increased in one or both of the transverse and longitudinal directions. These curvatures are limited so that the curvature in the longitudinal direction must not be significantly less than zero. The curvature in the transverse direction must not be less than the tubular transverse curvature of the contacted surface. The tubular transverse curvature sign is considered with respect to the forming tool reference; thus the outer surface transverse curvature sign is negative and the inner positive.

Thus when the method of the present invention is used to form the edges of longitudinally oriented slots, and it is desired to obtain slots having a high rate of divergence by increasing the forming tool curvature in the transverse direction, the difficulty of alignment experienced by methods in the prior art relying on forming by applying pressure along the slot edges is removed.

While slotted liners for wells are generally provided with longitudinally oriented slots, other slot orientations may be desirable for well completions or indeed for other applications such as filters used for various fluid cleaning purposes. Methods in the prior art, as described by Hruschak, are limited to longitudinally oriented slots.

A further purpose of the present invention is therefore to provide a method to narrow the width of slots placed in the wall of tubulars at any orientation, where such slotted tubulars are suitable for use as screens in wells or other similar filter applications. This purpose is realized because the sweep pattern employed in the method of the present invention ensures that all the slot edges are traversed regardless of orientation. The sweep pattern may be adjusted to improve the efficiency of the forming process, however a generally helical pattern is preferred.

DESCRIPTION OF THE PREFERRED EMBODIMENT

Figure 1:
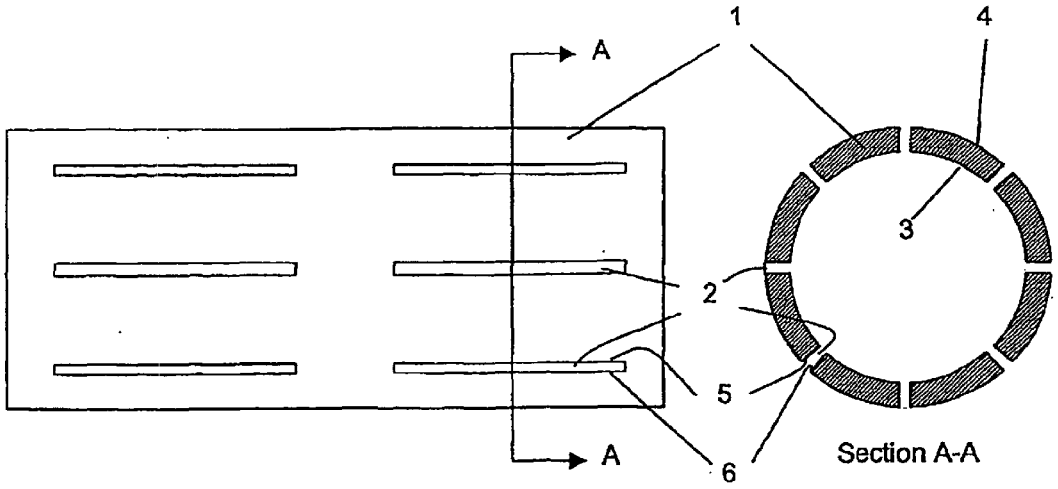
FIG. 1 Illustration of typical slotted liner tubular interval having circumferentially distributed longitudinal slots in rows.
Figure 2:
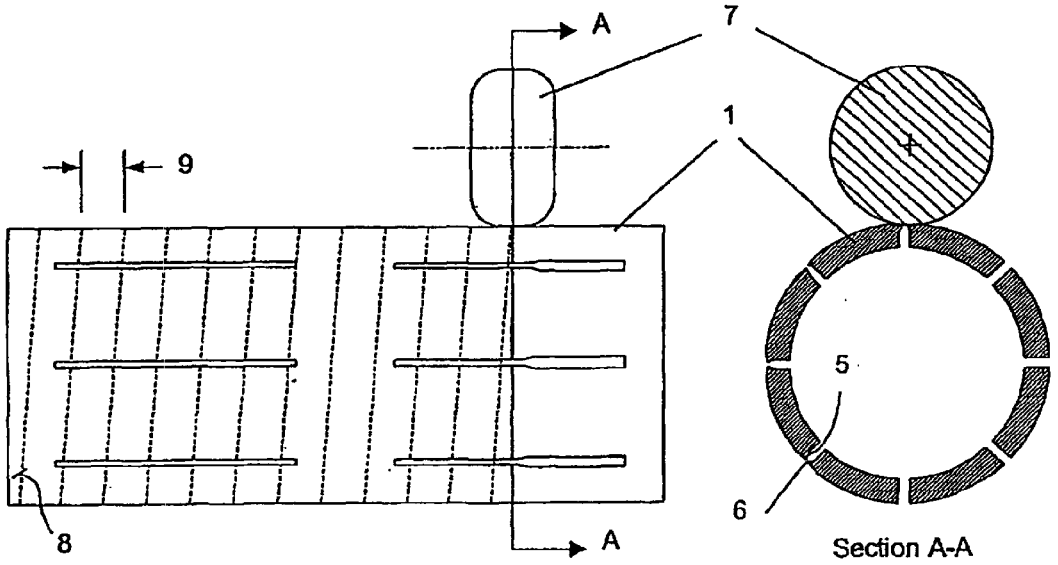
FIG. 2 Illustration of the slots contained in the slotted liner illustrated in FIG. 1 being formed by a contoured forming roller.

According to the preferred embodiment of the present invention, a metal tubular 1, the work piece, is provided having an exterior surface 2 and interior surface 3 and having one or more longitudinal slots 4, each having exterior longitudinal peripheral edges 5 and 6 as illustrated in FIG. 1. To reduce the width between exterior peripheral edges 5 and 6 of slots 4 a contoured rigid forming tool, configured as a forming roller 7 in the preferred embodiment, is provided and forced into contact with the exterior surface 2 of the metal tubular 1 to apply localized pressure while being moved largely transversely with respect to the tubular pipe along a helical path 8 as shown in FIG. 2. Sufficient pressure must be applied through the contoured forming roller 7 to plastically deform the peripheral edges 5 and 6 of the slots 4 as the roller traverses the slots 4 following the helical path 8. The pitch 9 and total length of the helical path 8 is adjusted to ensure the localized zones of plastic deformation caused when the roller sequentially traverses a given slot occur at close enough intervals to effectively continuously deform the slot along its entire length.

FIG. 2 illustrates the forming process at an intermediate step where the slot width at peripheral edges 5 and 6 of slots already traversed by the forming roller 7 following the helical path 8 have been narrowed. The location of Section A—A, shown in FIG. 2 was selected to show the contrast in slot width between the longitudinal interval of slots already traversed and the remainder of the slot length yet to be traversed.

Given the teachings of the present method, it will be apparent to one skilled in the art that for a given work piece there exists a relationship between the reduction in slot width and the:

radial force applied to the forming roller, shape of the forming roller, pitch of the helical forming path, number of times the roller traverse is repeated, and to a limited extent, the speed at which the roller is moved relative to the tubular surface.

The manner in which these variables interact to control the degree of forming is highly interactive and is best determined empirically but may be generally understood as follows:

The greater the available force the greater the amount of plastic deformation possible.

For a given available force, the shape of the forming roller generally controls the magnitude and longitudinal extent over which the reduction in slot width occurs for a single traverse of the roller over a slot. Manipulation of the roller shape is generally constrained such that an increase in the longitudinal extent of forming can only be obtained at the expense of slot width reduction and vice versa.

The pitch of the helical forming path must be co-ordinated with the axial extent over which the reduction in slot width occurs for a single traverse of the roller over a slot to ensure the width reduction occurs over the entire longitudinal extent of the slot.

Repeated traverses of the roller over the same slot location at the same load tend to increase the amount of deformation by incrementally smaller amounts as the number of traverses is increased.

Speed must not introduce undesirable dynamic effects.

While it is expected that for most applications a satisfactory reduction in slot width can be achieved with a constant roller load and helical pitch, it will be evident that both these control parameters may be varied during forming to increase or decrease the magnitude of slot narrowing over specific axial intervals along the tubular length. For example, it may be necessary to decrease the pitch when the forming roller is traversing the end regions of slots to obtain a satisfactory degree of narrowing.

For production purposes, it is generally desirable to obtain the maximum pitch as this increases the rate of forming for a given speed. As noted above, the pitch, while influenced by other factors, is limited by the maximum allowable radial force.

The maximum radial force which may be applied to the forming roller is a function of the manner in which the slotted tubular is supported and hence how the force applied through the roller is reacted. It will be evident that there exist numerous means of supporting the work piece and reacting the radial force applied through a forming roller 7 including providing support on the inside of the tubular. However it is most convenient if fixturing acting primarily on the exterior surface 2 can support the work piece and is arranged to react the radial force applied through a forming roller to the work piece through one or more opposing radial rollers acting at or near the same axial plane. The rollers most conveniently apply these opposing radial forces when mounted in a common rigid frame, similar to the manner of a 'steady rest' commonly used to support a long work piece in a lathe. It will be evident that more than one of these rollers can be arranged to act as forming rollers, in which case interleaved 'multiple start' helical paths can be generated as a function of the pipe rotation with respect to the rollers with associated benefits in production rate.

Figure 3:
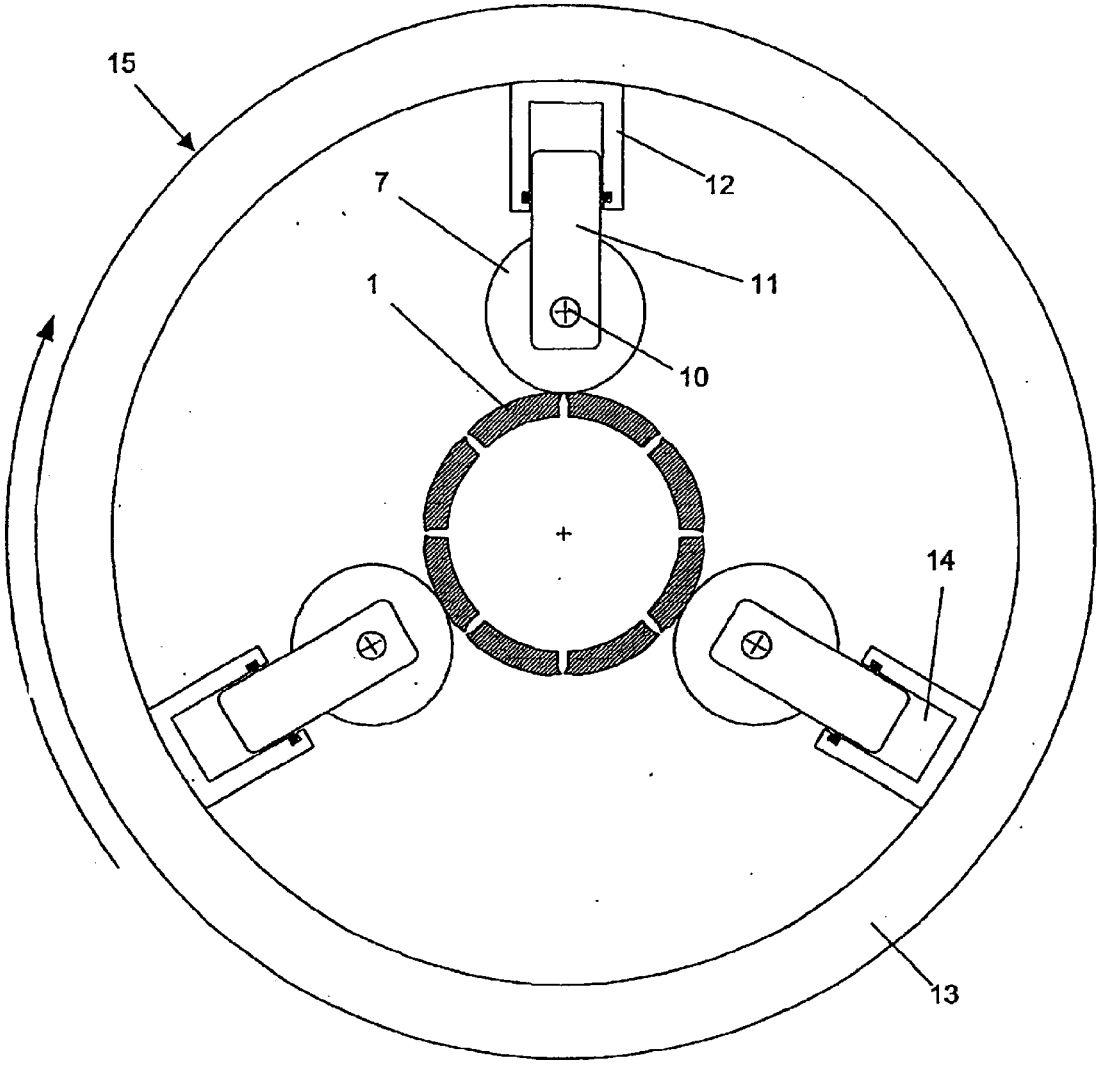
FIG. 3 Cross-sectional view of a fixture carrying three radially opposed forming rollers, which assembly together comprises a forming head.

One such configuration found to be practical is shown in FIG. 3. As illustrated there, the axles 10 of three radially opposed forming rollers 7 are attached to the pistons 11 of three hydraulic actuators 12, each positioned at approximately 120° around the work piece and fastened to the forming head frame 13. Load is applied to the forming rollers 7 by application of fluid pressure 14. Together this assembly is referred to as a forming head 15. This configuration substantially reduced the tendency of the work piece to bend and provides a radial load capacity enabling a reasonably large formed zone without permanent distortion of the work piece cross sectional shape for typical slotted tubular materials.

Continuing consideration of the manner in which the work piece is supported, the means by which one or more forming rollers 7 carried in a forming head assembly 15 is caused to move in a helical path 8, with respect to the work piece, may be accomplished in various ways. However two principal architectures present themselves as most practical. Firstly, with respect to the earth, the work piece may be rotated and the forming head caused to move axially in synchronism with the rotational position, in the manner of a lathe used for threading or turning operations. Secondly, the forming head may be rotated with respect to the earth and the work piece caused to move axially through the head without rotation, in synchronism with the forming roller rotation.

Figure 4:
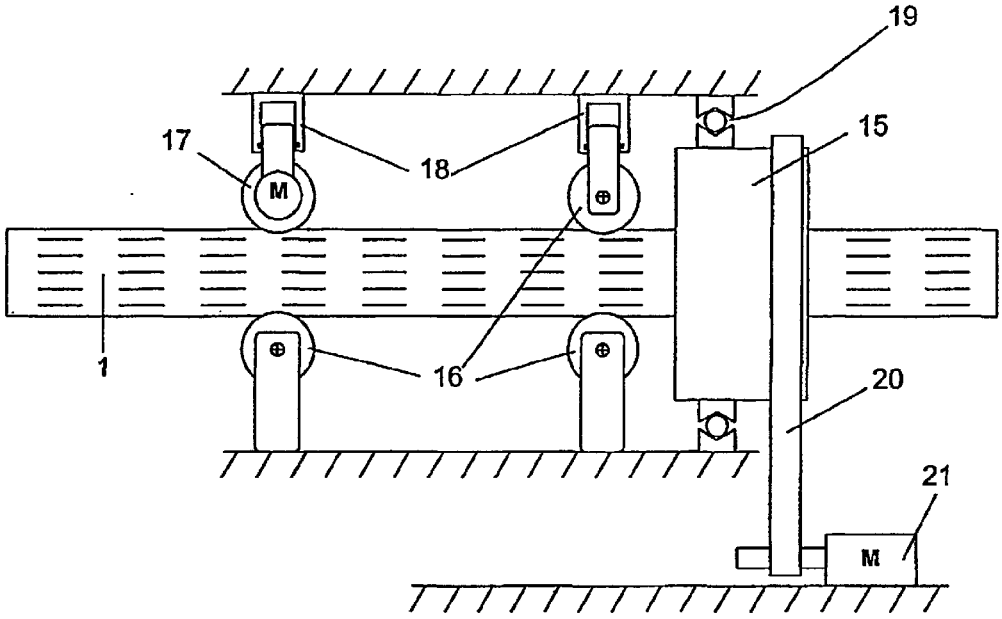
FIG. 4 Illustration of machine architecture employing rotating forming head.

In its preferred embodiment, the present invention employs the second of these architectures in a machine illustrated in FIG. 4. As shown there, the work piece or slotted metal tubular 1 is positioned with respect to the forming head 15 by guide rollers 16 and drive roller 17. Force applied by hydraulic actuators 18 ensure the work piece is held and the drive roller 17 develops sufficient friction to axially displace the work piece with respect to the forming head 15 while the forming head is rotating. The forming head 15 is mounted in bearings 19 allowing it to be rotated by means of a drive belt 20 driven by motor 21. The combination of axial and rotational motions thus provided, causes the forming rollers 7 to follow helical paths along the outside surface of the work piece, the pitch 9 of which helical paths is controlled by adjusting the axial feed rate with respect to the rotating speed of the forming head.

Figure 5:
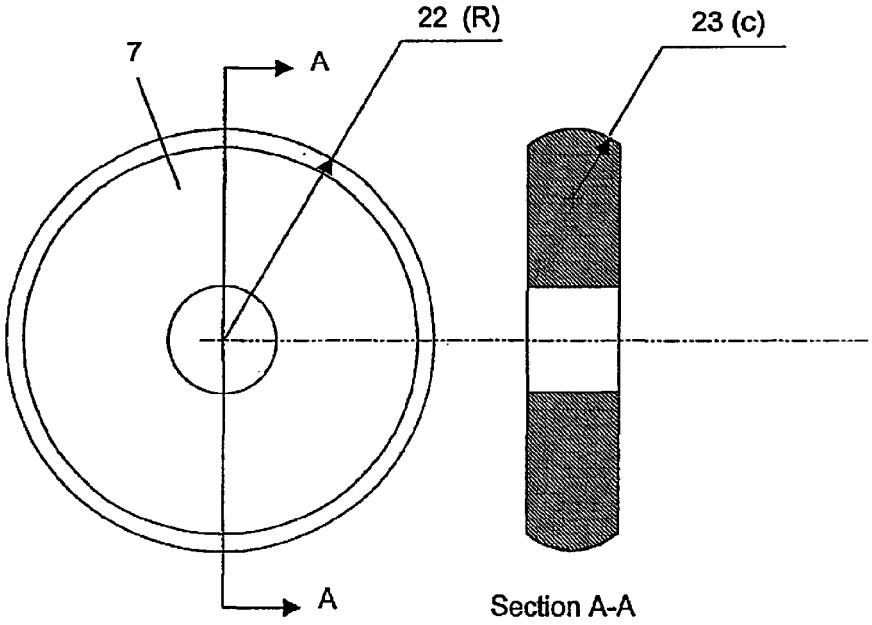
FIG. 5 Illustration of roller geometry parameters

As introduced above, the shape of the forming tool, or preferably forming roller, may be used in combination with the other process control variables of load, pitch and number of roller traverses to adjust the amount by which a slot is narrowed and the depth over which the narrowing occurs. The means by which roller shape controls these outcomes may be generally characterized in terms of the roller radius (R) 22 and profile radius (c) 23 as illustrated in FIG. 5. While the profile shape may take various forms, a simple convex shape, as shown in FIG. 5, was found to provide satisfactory control of slot width reduction when forming longitudinal slots following a largely transverse helical path as anticipated for the preferred embodiment.

Figure 6:
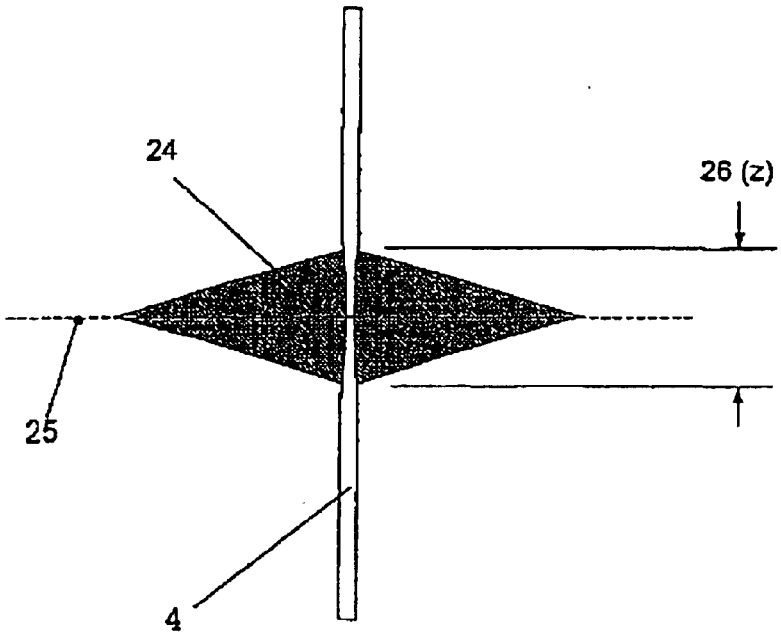
FIG. 6 Plan view of longitudinal slot transversely rolled showing areal extent of plastic deformation zone.
Figure 7:
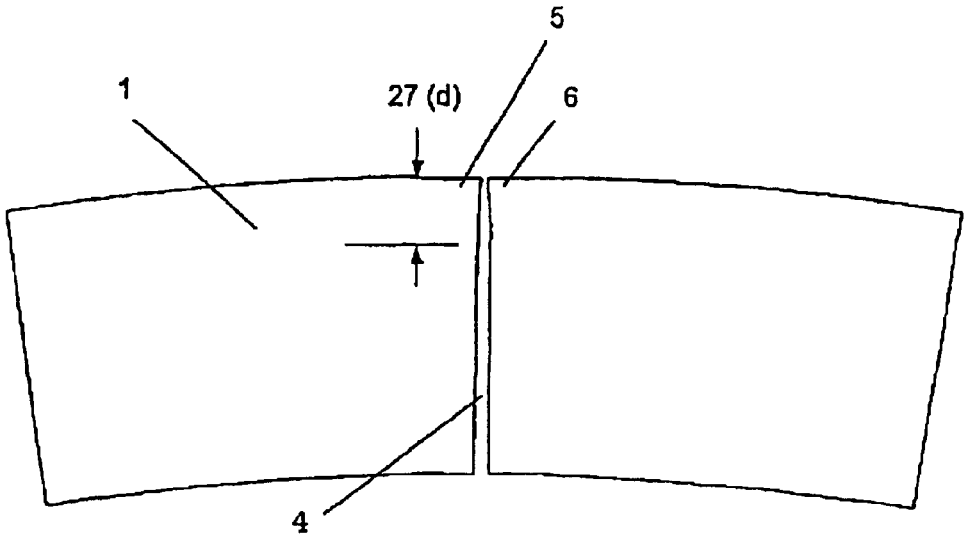
FIG. 7 Cross-sectional view of slot shape after forming by transverse rolling.

To understand how these geometric parameters may be advantageously manipulated, consider the shape of the zone of plasticity caused as a roller, having a generally smooth convex profile shape, crosses the centre of a slot following a largely transverse path. As shown in FIG. 6 the width of the areal extent of plastic deformation 24 as a function of position along the roller path 25, caused when the roller traverses the slot, tends to be greatest nearest the slot. This occurs because the stressed material is least confined at the slot and creates an effective formed length (z) 26 for a single traverse of the forming roller over a slot. Correspondingly, the depth of plastic deformation is greatest at the slot, producing narrowing of the through wall channel shape to forming depth (d) 27 as shown in FIG. 7. It will be apparent that if the pitch exceeds z, the areal extent of successive roller traverses will not overlap sufficiently along the slot edges to effectively continuously narrow the slots over their entire length, and the slot is said to be under-formed. Within the context of the preferred embodiment, there is a maximum allowable roller load (F) dependent on the structural capacity of the work piece when loaded by the forming rollers within the forming head. Furthermore the amount by which the slot width is to be narrowed (Δw) may be treated as a given for purposes of understanding choice of forming roller radius (R) 22 and profile radius (c) 23. To maximise production rate it is preferable to produce the required reduction in slot width by only rolling the surface of the work piece once with the roller load at or near the maximum allowable. Under these assumptions then, for a given roller radius 22, there exists a minimum profile radius (c), referred to as the critical radius, for which the desired Δw is obtained for a single traverse of the slot, as illustrated in FIG. 6, with corresponding value of formed length z. For these 'optimum' conditions the pitch must largely correspond to z to avoid either under or over forming the slot. Pitch (P) may therefore be treated as a dependent variable. Such a minimum profile radius is also optimised to form the edges most completely to the ends of the slots.

Next consider the effect of variations in R assuming c is 'optimally' selected as just described. It will be apparent that as R is decreased the extent of the zone of stress under the roller is reduced in the direction of rolling (normal to the slot direction) therefore c must be increased to maintain the condition of constant Δw and z will correspondingly increase. Because pitch increases with z the rate of production increases for decreasing R. It should also be apparent that the forming depth (d) 24 will decrease as R is decreased due to the reduced extent of the zone of stress under the roller, normal to the slot direction. This provides a means to control the shape of the formed edges concurrent with the rate of divergence in the flow channel.

However, it is preferable if the profile radius (c) is somewhat greater than the critical value as this allows greater flexibility in accommodating randomness in the numerous variables, such as material properties, affecting slot width. The greater flexibility derives from the fact that as c becomes greater than critical, the pitch must on average be reduced to maintain Δw constant. Thus if variations in parameters such as an decrease in strength require less forming, the pitch may be increased to compensate without causing under forming. This ability to use variation in pitch to provide fine control of the final slot width is of practical benefit for automating the process. In particular, if the slot width is measured directly after the slots are formed, variations from the desired width may be compensated for subsequent formed intervals by adjusting either the load or pitch but preferably the pitch. This feedback task may be performed manually or automated using a suitable means to measure slot width.

Therefore in its preferred embodiment, the roller and profile radii are selected to ensure adequate sensitivity of slot width to pitch is maintained to facilitate process control without compromising the ability of the roller to form the edges of slots near their ends.

The embodiments of the invention in which an exclusive property or privilege is claimed are defined as follows:

1. A method of reducing slot width in slotted tubular liners, comprising the steps of:

(a) providing a slotted tubular liner having an interior surface, an exterior surface and a plurality of slots extending between the interior surface and the exterior surface;

(b) providing at least one contoured rigid forming tool;

(c) applying pressure to a selected one of the interior surface and the exterior surface of the slotted tubular liner with the at least one contoured rigid forming tool; and (d) moving the at least one contoured rigid forming tool, relative to the slotted tubular liner, in a sweep pattern traversing the selected one of the interior surface and the exterior surface of the slotted tubular liner, until plastic deformation narrows the width of the plurality of slots, as measured at the selected one of said interior and exterior surfaces, to within desired tolerances:

wherein the direction of relative movement of the at least one rigid forming tool is largely transverse to the longitudinal axis of the slotted tubular liner.

2. The method as defined in claim 1, the contoured rigid forming tool being a roller.

3. The method as defined in claim 1, there being several contoured rigid forming tools positioned at spaced intervals circumferentially in relation to the selected one of the exterior surface and the interior surface of the slotted tubular liner.

4. The method as defined in claim 3, there being three contoured rigid forming tools positioned at 120 degree spaced intervals.

5. The method as defined in claim 1, the sweep pattern including two or more sweep paths, the sweep paths being closely spaced with overlapping zones of localized plastic deformation in proximity with edges of each slot.

6. The method as defined in claim 1, the sweep pattern being a helical path.

7. The method as defined in claim 1, the slotted tubular liner being rotated and the at least one contoured rigid forming tool being non-rotatably fixed and moving axially along the slotted tubular liner.

8. The method as defined in claim 1, the at least one contoured rigid forming tool being rotated and the slotted tubular liner being non-rotatably fixed and moving axially past the at least one contoured rigid forming tool.

9. The method as defined in claim 1, the at least one contoured rigid forming tool being rotated and also being moved axially along the slotted tubular liner, with the tubular liner being non-rotatably fixed and axially stationary.

10. The method as defined in claim 1, the at least one contoured rigid forming tool being non-rotatably fixed, with the tubular liner being rotating and moving axially past the at least one contoured rigid forming tool.

11. The method of claim 2 wherein the roller is contoured to have a convexly radiused profile.

12. The method of claim 2 wherein the roller is contoured to include a cylindrical portion.

13. Apparatus for reducing the width of slots in a slotted round tubular liner having an interior surface, an exterior surface and a plurality of slots extending between the interior surface and the exterior surface, said apparatus comprising:

(a) a forming head frame having a centroidal axis, said forming head frame being adapted to receive a slotted liner such that the longitudinal axis of the slotted liner substantially coincides with the centroidal axis of the forming head frame;

(b) one or more forming tools;

(c) mounting means, for mounting said one or more forming tools to the forming head frame such that each of the one or more forming tools may be extended radially inward relative to the centroidal axis of the forming head frame;

(d) actuating means, for urging the one or more forming tools into contact with the exterior surface of the slotted liner under a selectively variable radial load;

(e) rotation means, for causing rotational movement of the one or more forming tools relative to the axis of the slotted liner; and (f) axial movement means, for causing axial movement of the forming head frame relative to the slotted liner;

wherein concurrent actuation of the rotation means and the axial movement means, with the one or more forming tools in contact with the slotted liner under radial loading of sufficient magnitude, will cause each forming tool to trace a sweep pattern around the exterior surface of the slotted liner, until plastic deformation narrows the width of the slots, as measured at the exterior surface of the liner, to within desired tolerances.

14. The apparatus of claim 13 wherein the sweep pattern is a helical path.

15. The apparatus of claim 13 wherein, with respect to at least one of said one or more forming tools:

(a) the mounting means comprises a hydraulic actuator mounted to the forming head frame, said actuator having a piston extensible radially inward and retractable radially outward relative to the centroidal axis of the forming head frame;

(b) the forming tool is mounted to the radially inward end of the piston; and (c) the actuating means comprises means for delivering hydraulic pressure to the actuator, for selectively extending or retracting the piston.

16. The apparatus of claim 13 wherein:

(a) the forming head frame is axially stationary;

(b) the rotation means comprises means for rotating the forming head frame about its centroidal axis; and (b) the axial movement means comprises means for moving the slotted liner axially through the forming head frame.

17. The apparatus of claim 13 wherein:

(a) the forming head frame is non-rotatably fixed;

(b) the rotation means comprises means for rotating the slotted liner about its centroidal axis; and (c) the axial movement means comprises means for moving the forming head frame axially along the slotted liner such that the liner moves through the forming head frame.

18. The apparatus of claim 13 wherein:

(a) the slotted liner is non-rotatably fixed;

(b) the rotation means comprises means for rotating the forming head frame about its centroidal axis; and (c) the axial movement means comprises means for moving the forming head frame axially along the slotted liner such that the liner moves through the forming head frame.

19. The apparatus of claim 13 wherein:

(a) the forming head frame is non-rotatably fixed;

(b) the rotation means comprises means for rotating the slotted liner about its centroidal axis; and (c) the axial movement means comprises means for moving the slotted liner axially through the forming head frame.

20. The apparatus of claim 13 wherein at least one of the one or more forming tools is a roller.

21. The apparatus of claim 20 wherein the roller is contoured to have a convexly radiused profile.

22. The apparatus of claim 20 wherein the roller is contoured to include a cylindrical portion.

23. The apparatus of claim 20 wherein the roller is rotatable around an axis substantially parallel to the centroidal axis of the forming head frame.

24. The apparatus of claim 20 wherein the roller is a castering roller.

25. The apparatus of claim 13, further comprising rotational speed control means, for regulating the rotational speed of the one or more forming tools relative to the slotted liner.

26. The apparatus of claim 13, further comprising axial speed control means, for regulating the axial travel speed of the forming head frame relative to the slotted liner.

27. The apparatus of claim 16 wherein the rotation means comprises a plurality of bearings disposed about the exterior circumferential surface of the forming head frame, said bearings being adapted to support and retain the forming head frame and allow it to rotate about its centroidal axis.

28. The apparatus of claim 27, further comprising drive means for rotating the forming head frame.

29. The apparatus of claim 28 wherein the drive means comprises a motor.

30. The apparatus of claim 29, further comprising a drive belt for transferring rotational motion from the motor to the forming head frame.

31. The apparatus of claim 16 wherein the axial movement means comprises:

(a) a plurality of rollers, said guide rollers being adapted to engage the slotted liner so as to keep the liner in substantially co-axial alignment with the forming head frame, at least two of said guide rollers being disposed so as to support the weight of the liner; and (b) at least one drive roller, said drive roller being rotatable by a power source about an axis transverse to the axis of the liner; and (c) drive roller engagement means, for engaging the at least one drive roller with the liner such that rotation of the at least one drive roller will cause axial movement of the liner.

32. The apparatus of claim 31 wherein the drive roller engagement means comprises a hydraulic actuator for urging the at least one drive roller into contact with the liner.

33. The apparatus of claim 13 having a plurality of forming tools positioned at spaced intervals circumferentially in relation to the exterior surface of the slotted tubular liner.

* * * * *

UNITED STATES PATENT AND TRADEMARK OFFICE

CERTIFICATE OF CORRECTION

PATENT NO. : 6,898,957 B2
APPLICATION NO. : 10/399990
DATED : May 31, 2005
INVENTOR(S) : Slack, Maurice William It is certified that error appears in the above-identified patent and that said Letters Patent is hereby corrected as shown below:

Drawings,
Sheet 1, Fig. 1, reference numeral 2 should be applied to the exterior surface of the tubular (rather than reference numeral 4).
Sheet 1, Fig. 1, reference numeral 4 should be applied to the slots in the tubular (rather than reference numeral 2).

Column 9,
Line 58, after "liners" insert -- having largely longitudinally oriented slots --.
Line 62, after "surface" insert -- , said slots being oriented largely longitudinally relative to the axis of the liner --.

Signed and Sealed this

Fourth Day of July, 2006

JON W. DUDAS
*Director of the United States Patent and Trademark Office*